US008534969B2

(12) United States Patent
Guo et al.

(10) Patent No.: US 8,534,969 B2
(45) Date of Patent: Sep. 17, 2013

(54) APPARATUS AND METHOD FOR PACKING CONCENTRATED MASS LOADS FOR TRANSPORT BY CONTAINER, BOX TRUCK AND VAN TRAILER

(75) Inventors: Tony Guo, Hamilton (CA); Robert A. Edwards, Hamilton (CA)

(73) Assignee: CareGo Innovative Solutions, Inc., Hamilton, Ontario (CA)

( * ) Notice: Subject to any disclaimer, the term of this patent is extended or adjusted under 35 U.S.C. 154(b) by 0 days.

(21) Appl. No.: 13/228,944

(22) Filed: Sep. 9, 2011

(65) Prior Publication Data

US 2012/0060725 A1 Mar. 15, 2012

Related U.S. Application Data

(60) Provisional application No. 61/381,357, filed on Sep. 9, 2010, provisional application No. 61/417,565, filed on Nov. 29, 2010.

(51) Int. Cl.
*B60P 7/06* (2006.01)

(52) U.S. Cl.
USPC ..... 410/46

(58) Field of Classification Search
USPC ..... 410/46, 101, 71
See application file for complete search history.

(56) References Cited

U.S. PATENT DOCUMENTS

| | | | | |
|---|---|---|---|---|
| 3,429,536 | A * | 2/1969 | Weingarten et al. | 410/77 |
| 3,924,871 | A * | 12/1975 | Mesenbring | 280/845 |
| 3,972,500 | A * | 8/1976 | Johnson et al. | 410/85 |
| 4,343,401 | A * | 8/1982 | Paulyson | 206/577 |
| 4,521,941 | A * | 6/1985 | Gerhard | 24/287 |
| 4,591,307 | A * | 5/1986 | Clive-Smith | 410/83 |
| 5,547,321 | A * | 8/1996 | Thomas | 410/102 |
| 6,364,584 | B1 * | 4/2002 | Taylor | 410/94 |
| 6,817,578 | B1 * | 11/2004 | Garcia et al. | 244/137.1 |
| 6,923,606 | B2 * | 8/2005 | Fehrle et al. | 410/46 |
| 7,275,902 | B1 * | 10/2007 | Klotz | 410/42 |
| 7,491,024 | B2 * | 2/2009 | Heinrichs et al. | 410/32 |
| 8,083,448 | B2 * | 12/2011 | Heinrichs et al. | 410/32 |
| 2003/0161700 | A1 * | 8/2003 | Moore | 410/102 |
| 2004/0245397 | A1 * | 12/2004 | Garcia et al. | 244/137.1 |
| 2009/0162162 | A1 * | 6/2009 | Manesis | 410/100 |

* cited by examiner

*Primary Examiner* — H Gutman
(74) *Attorney, Agent, or Firm* — Young Basile Hanlon & MacFarlane PC

(57) ABSTRACT

A load equalizing pallet apparatus for transporting a concentrated load and for use with load binders comprises a load equalizing base and a plurality of shoes. The base is constructed substantially of wood, has a periphery and, in use, receives said load. The shoes are metal and, in use, are arranged about the periphery of the base and rigidly engaged thereto. Each shoe has a plurality of lugs, the lugs, in use, being engaged by said load binders to couple said load to said pallet.

16 Claims, 18 Drawing Sheets

APPARATUS AND METHOD FOR PACKING CONCENTRATED MASS LOADS FOR TRANSPORT BY CONTAINER, BOX TRUCK AND VAN TRAILER

This application claims priority on U.S. Provisional patent application No. 61/381,357 filed Sep. 9, 2010 and U.S. Provisional patent application No. 61/417,565 filed Nov. 29, 2010, incorporated herein by reference.

FIELD OF THE INVENTION

The present invention relates to the transportation of concentrated mass loads by container, box truck and van trailer and apparatus for use in transporting concentrated mass loads by container, box truck and van trailer. The invention has application to the transportation of, inter alia, coils and reels.

BACKGROUND OF THE INVENTION

It is known to ship steel coils by container, box truck and van trailer. However, because of the very large mass associated with a steel coil, and the localized nature thereof, known methods for shipping steel coils by container, box truck and van trailer often involve relatively expensive, bulky pallets which are loaded with coils, which are slid or rolled into the cargo area for transport and which spread the load of the coils over the cargo floor.

SUMMARY OF THE INVENTION

Forming one aspect of the invention is a load equalizing pallet apparatus for transporting a concentrated load and for use with load binders. The load equalizing pallet apparatus comprises: a load equalizing base constructed substantially out of wood, having a periphery and, in use, receiving said load; and a plurality of metal shoes arranged, in use, about the periphery of the base and rigidly engaged thereto, each shoe having a plurality of lugs, the lugs, in use, being engaged by said load binders to couple said load to said pallet.

According to another aspect of the invention, the base can be defined by a substantially rectangular lattice of dimensional timbers and the shoes can be arranged one at each corner of said lattice.

According to another aspect of the invention, the lattice of dimensional timbers can include a pair of parallel timbers and the ends of said pair of parallel timbers can define the corners of the lattice.

According to another aspect of the invention, each end of said pair of parallel timbers can be in receipt of a shoe, the shoe defining a socket which, in use, grippingly receives said each end.

According to another aspect of the invention, the shoe can have a pair of lugs which, in use, present upwardly and one or more lugs which, in use, project laterally outwardly from said pallet.

The pallet apparatus can be used as part of a method which forms another aspect of the invention. The method comprises the steps of: placing the pallet apparatus in a container, box truck or van trailer; placing said load on the pallet apparatus; securing the load to the pallet apparatus using load binding straps; and securing the pallet apparatus against movement.

According to another aspect of the invention, the pallet apparatus can be placed in the container and secured against movement by blocking the base inside the container using a framework of dimensional lumber constructed on the container floor.

According to another aspect of the invention, the pallet apparatus can be placed in the van trailer and secured against movement by nailing bracing to the floor of the van trailer.

The pallet apparatus can, in another aspect of the invention, form part of a shipping apparatus which includes, in addition to the pallet apparatus, a shelf apparatus defining, in use, a load-receiving surface disposed above the pallet apparatus.

According to another aspect of the invention, the shelf apparatus can comprise: a leg for each shoe, the leg being received, in use, in one of the laterally-outwardly projecting lugs of said each shoe.

According to another aspect of the invention, the shelf can comprise a pair of standards, each standard being defined in part by a pair of said legs, the legs of said each standard being rigidly secured to one another.

According to another aspect of the invention, the shelf apparatus can comprise one or more deck structures, each of said one or more deck structures spanning between and coupled to the pair of standards to space the standards apart.

Other advantages of the present invention will become evident upon review of the accompanying detailed description and drawings, the latter being briefly described hereinafter.

DETAILED DESCRIPTION OF THE EXEMPLARY EMBODIMENTS

As mentioned in the description thereof, the FIGURES show two exemplary embodiments of a load equalizing pallet 20 and 20', an exemplary embodiment of a shelf apparatus 22 and various partial, assembly and use views thereof.

Figure 1:
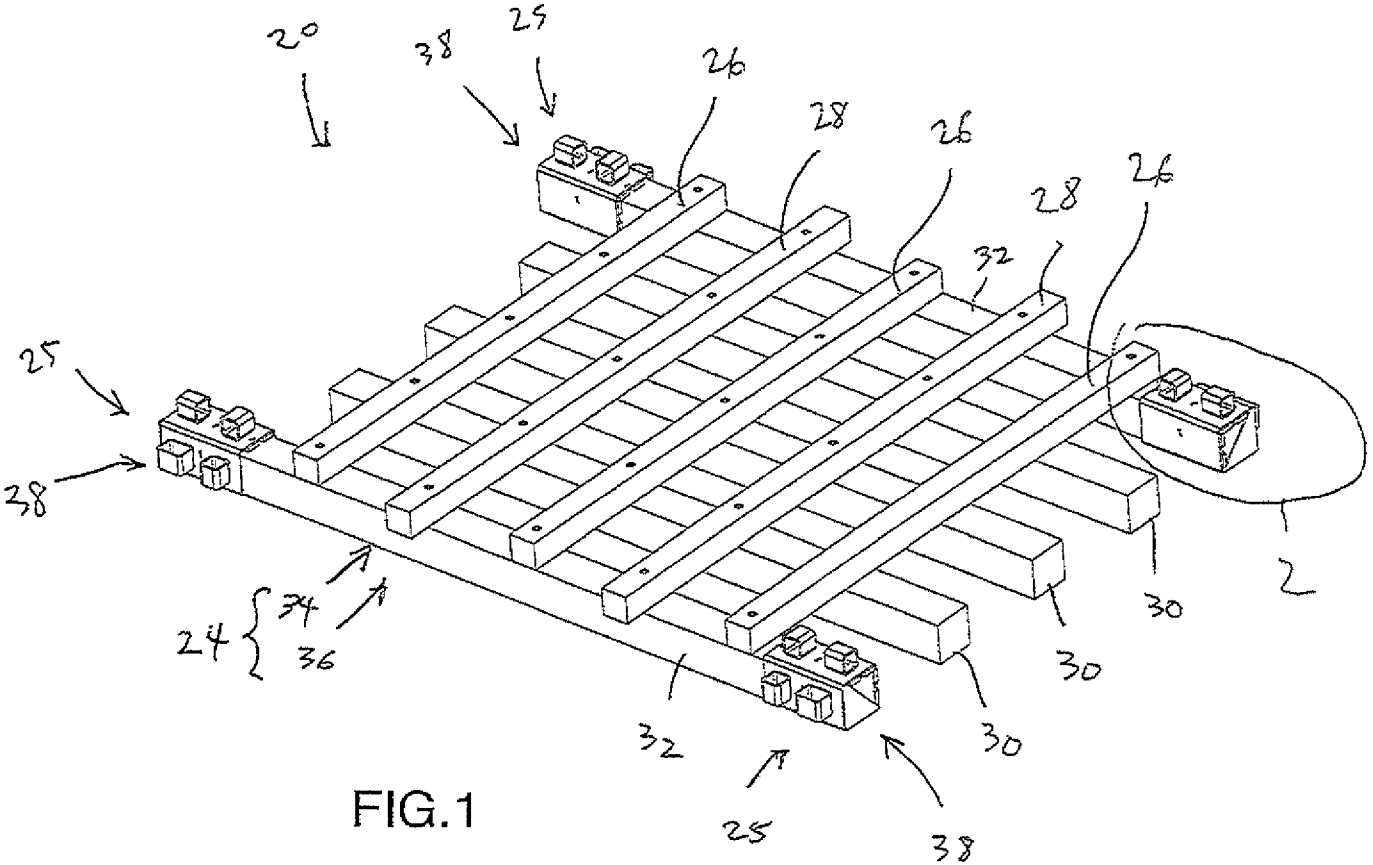
FIG. 1 is a perspective view of a load equalizing pallet apparatus according to an exemplary embodiment of the invention.
Figure 2:
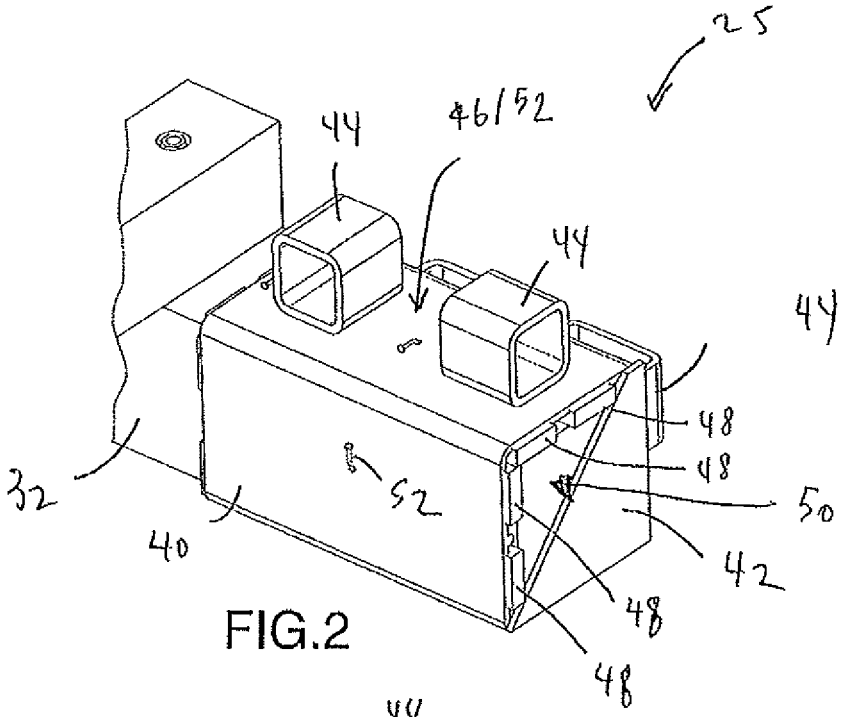
FIG. 2 is an enlarged view of encircled area 2 of FIG. 1.
Figure 3:
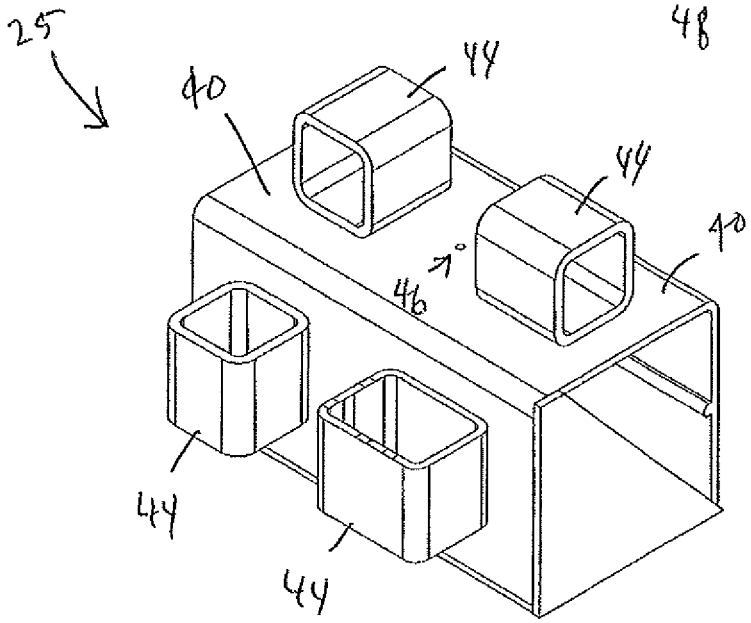
FIG. 3 is a view of the structure of FIG. 2 from another vantage point and with the load-equalizing base removed, for clarity.
Figure 4:
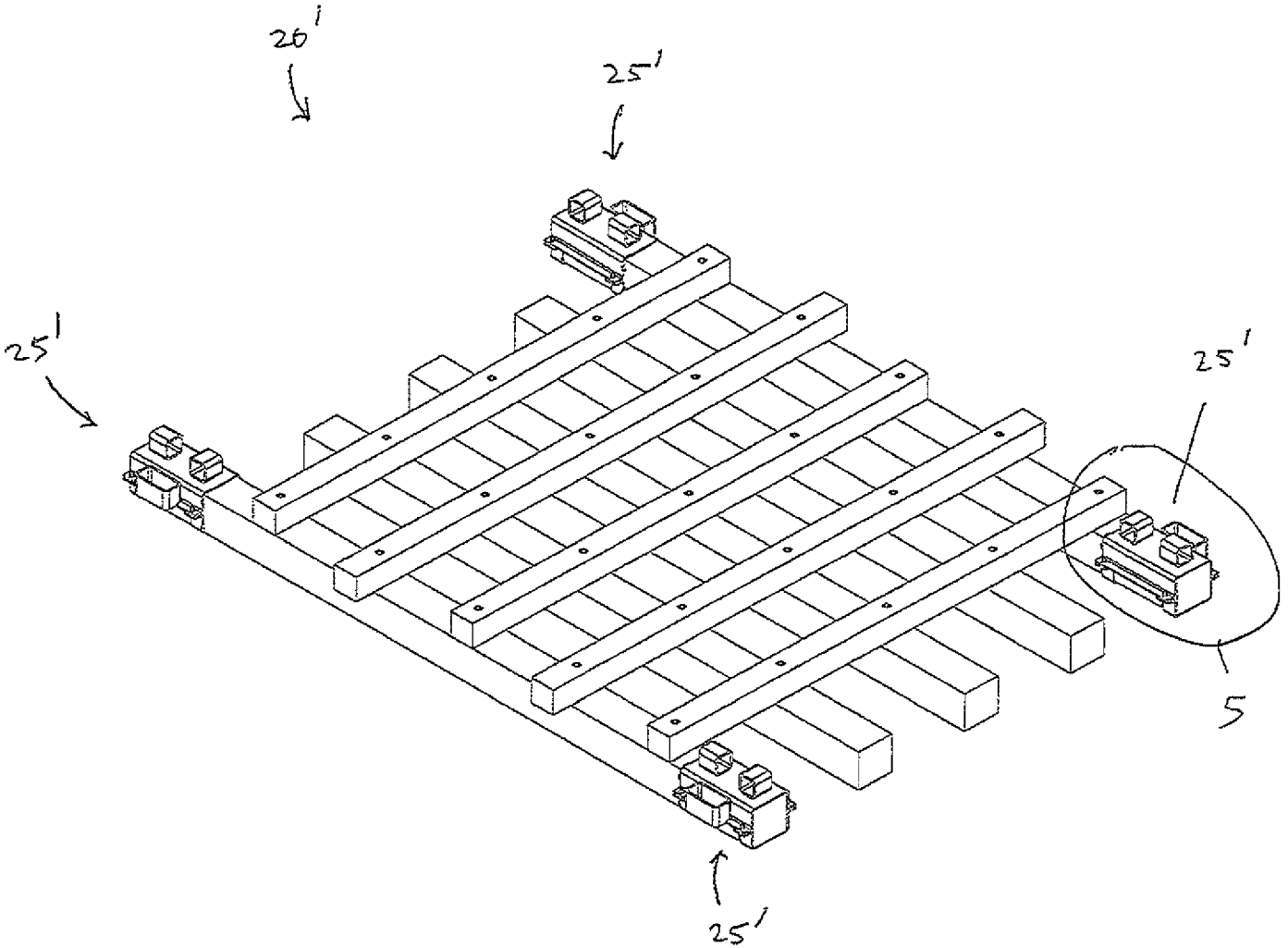
FIG. 4 is a view, similar to FIG. 1, of a load equalizing apparatus according to another embodiment.
Figure 5:
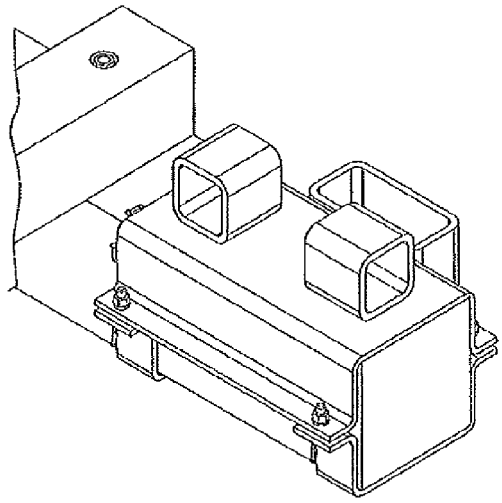
FIG. 5 is an enlarged view of encircled area 5 of FIG. 4.
Figure 6:
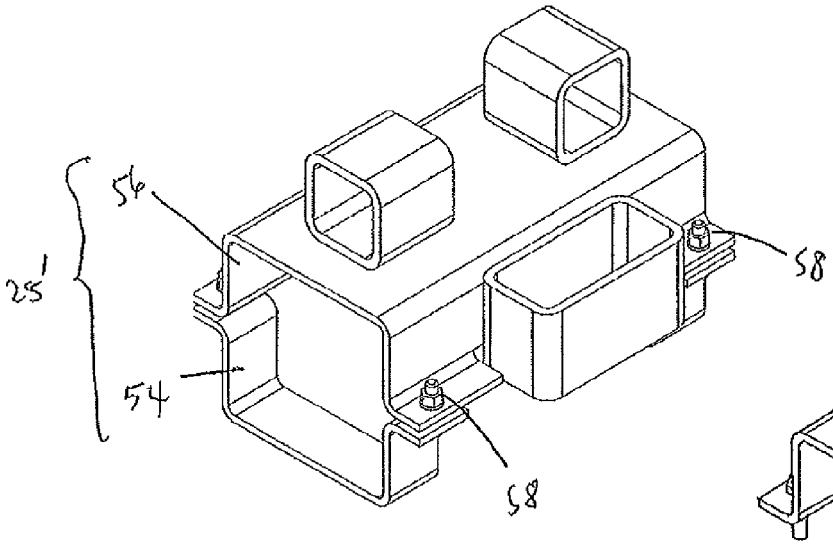
FIG. 6 is a view of the structure of FIG. 5 from another vantage point and with the load-equalizing base removed, for clarity.
Figure 7:
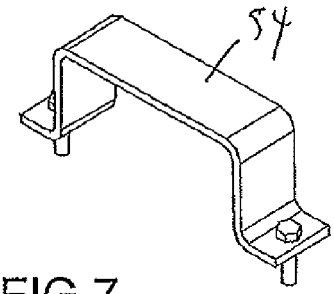
FIG. 7 is an enlarged view of a portion of the structure of FIG. 6.
Figure 8:
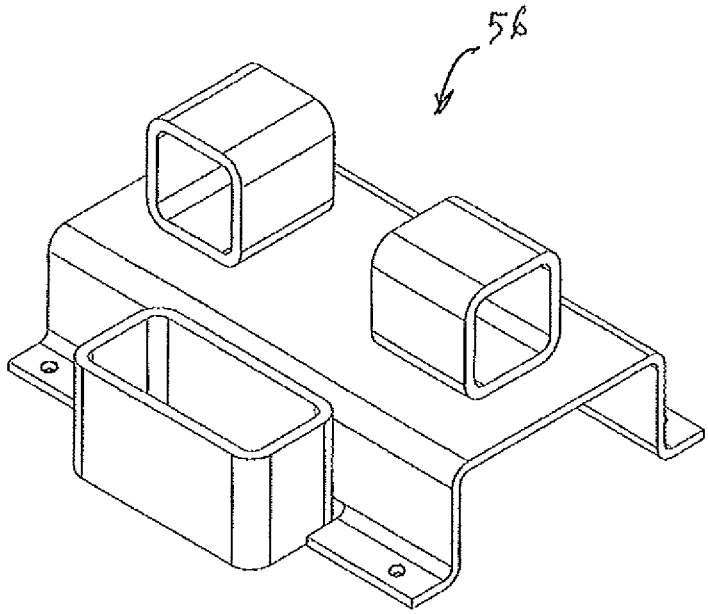
FIG. 8 is an enlarged view of another portion of the structure of FIG. 6

Turning first to the embodiment of the load equalizing pallet 20 shown in FIGS. 1-3, same will be seen to comprise a load equalizing base 24 and a plurality of shoes 25.

The load equalizing base 24 is constructed substantially out of wood and has a periphery. More particularly, base 24 is defined by a generally rectangular lattice of dimensional timbers 26, 28, 30, 32 arranged in two layers 34,36 and bolted together where they intersect, the lattice having a periphery with four corners 38, with the corners 38 being defined by the ends of the outermost pair of parallel timbers 32 in the lower layer 36.

With reference to FIG. 2 and FIG. 3, each shoe 25 will be seen to be defined by a square steel tube 40, partially closed at one end by a triangular steel plate 42, and having securely welded thereto, on two adjacent surfaces, a plurality of steel lugs 44. In two of the perpendicular surfaces of the steel tube 40, apertures 46 are formed.

As seen in FIG. 1, the shoes 25 are arranged around the periphery, more particularly, are rigidly secured one at each corner, with each shoe 25 being arranged such that a pair of lugs 44 present upwardly and one or more lugs 44 project laterally outwardly from said pallet apparatus 20.

As best seen in FIG. 2, the rigid securement of each shoe 25 involves the placement of shims 48 inside the steel tube 40, to form a socket 50 which grippingly receives the end of the timber, and driving nails 52 through the apertures 46, to secure the shims 48 in place and resist movement of the shoe 25 from the timber 32.

The load equalizing pallet 20' of FIGS. 4-8 is substantially functionally identical to that of FIGS. 1-3. However, rather than using the shim/nail arrangement for forming the socket, each shoe 25' is defined by a pair of half-shoes 54,56, which are tightly secured to one-another around the timber by bolts 58.

Figure 9:
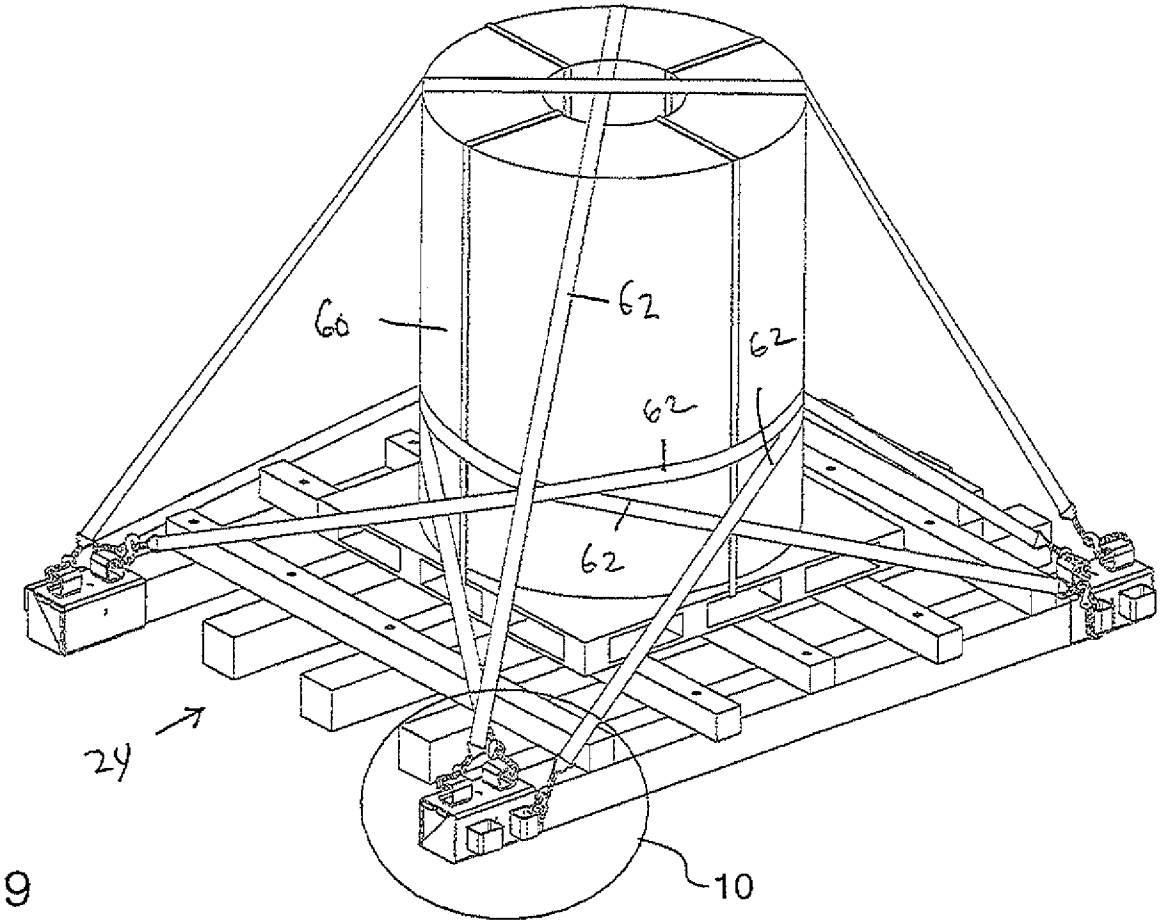
FIG. 9 is a perspective view of the structure of FIG. 1, with a palletized coil secured thereon by binders.
Figure 10:
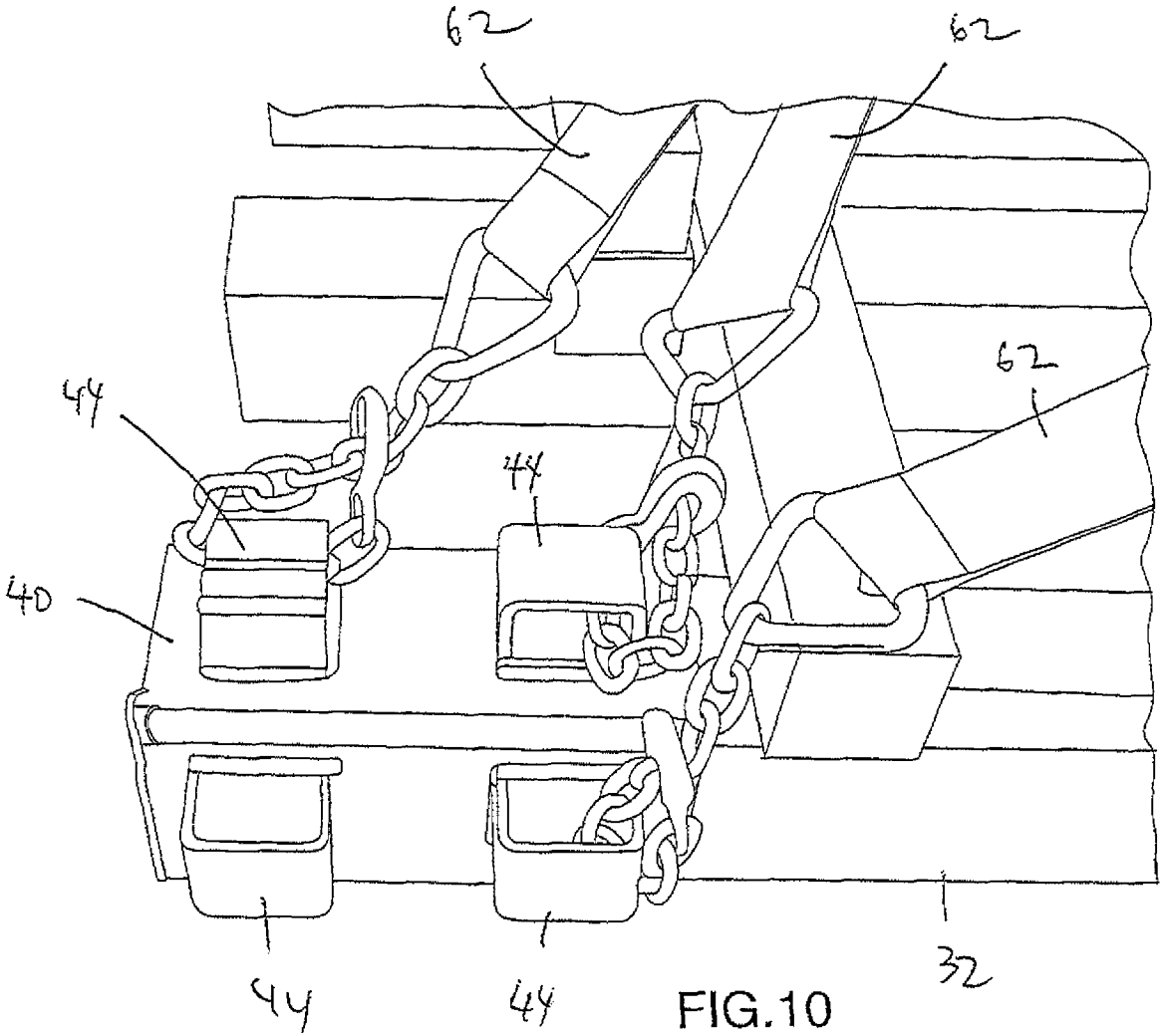
FIG. 10 is an enlarged view of encircled area 10 of FIG. 9.

Turning now to the assembly views of FIGS. 9 and 10, it will be understood that these views show the structure of FIGS. 1-3, with a concentrated load, namely, a palletized steel coil 60, positioned upon the base 24, and a plurality of load binding straps 62 holding the coil 60 to the base 24. This is the manner in which the apparatus 20 is used in certain of the methods that form part of the invention.

Figure 11:
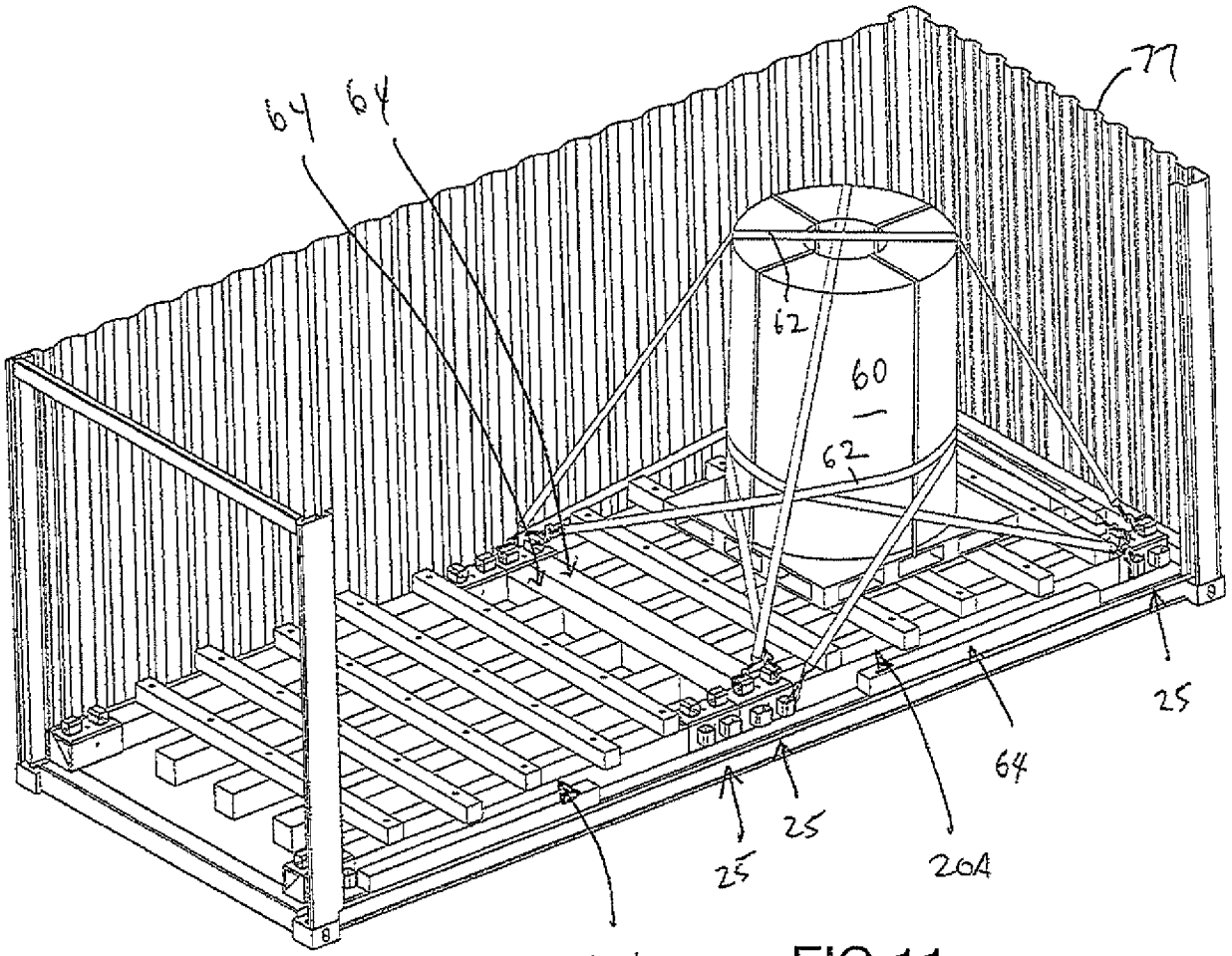
FIG. 11 is, inter alia, a schematic view of the structure of FIG. 9 positioned in a 40' shipping container.

With further regard to the methods, reference is now made to FIG. 11, which, as mentioned in the BRIEF DESCRIPTION, is a schematic view of the structure of FIG. 9 operatively positioned in a shipping container 77. This view shows an interim stage of the container method, i.e. the result of the steps of:

- placing a first load equalizing pallet apparatus 20A on the floor of the shipping container
- placing a palletized coil 60 on the first load equalizing pallet 20A;
- securing the coil/load to the first load equalizing pallet using load binding straps 62; and
- placing a second load equalizing pallet 20B on the floor of the shipping container Blocking 64 is also shown in FIG. 11, and it will be understood that this represents a partial attempt to secure the load equalizing pallets 20A,20B against movement.

To complete the method:

- a second palletized coil is placed on the second load equalizing pallet 20B and secured in place with load binding straps, in a manner identical to the placement and securement of the first; and
- the pallets are secured against movement by blocking the bases thereof inside the shipping container using a framework of dimensional lumber constructed on the container floor.

Figure 12:
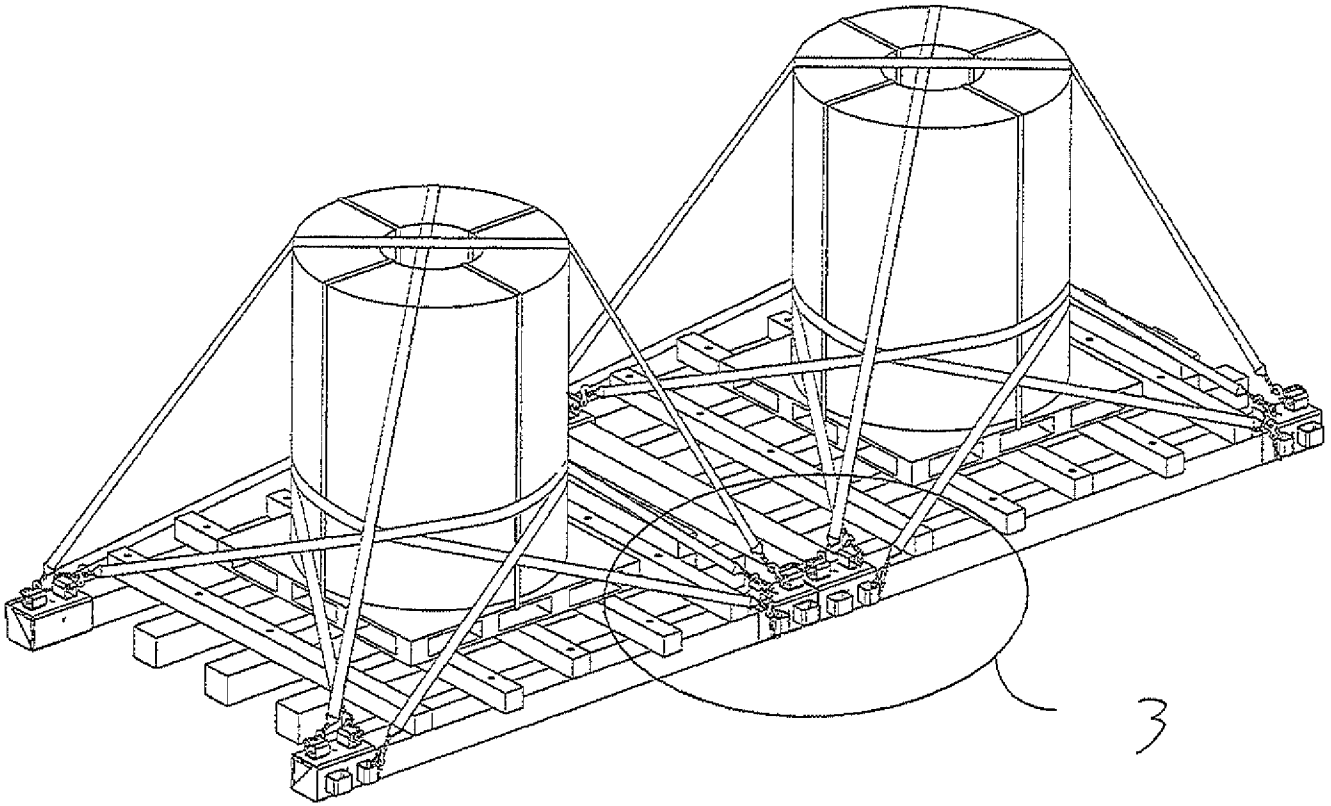
FIG. 12 is a view of the interior of a shipping container wherein a pair of the structures of FIG. 9 have been operatively positioned.
Figure 13:
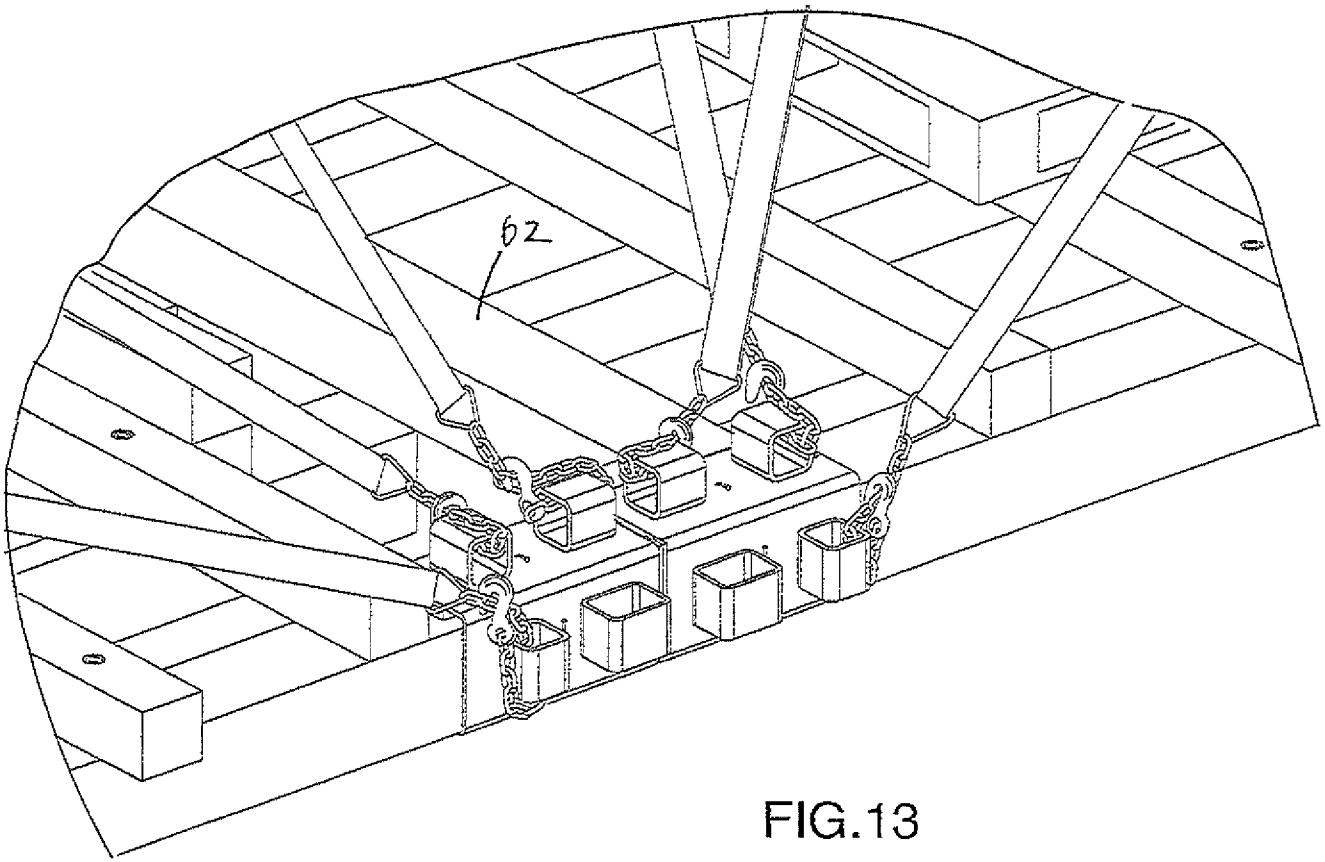
FIG. 13 is an enlarged view of encircled area 13 of FIG. 12.
Figure 14:
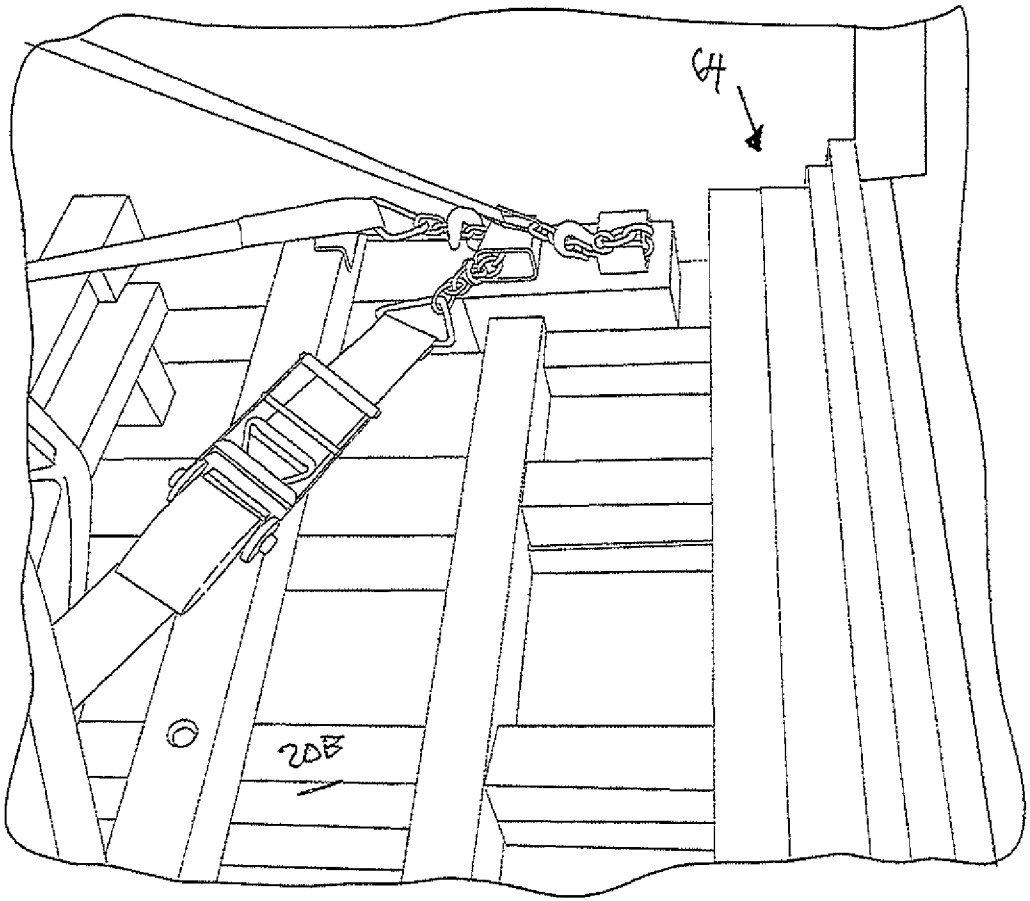
FIG. 14 is another view of the interior of the shipping container of FIG. 10.

FIGS. 12-14 are views showing the result of these completion steps, with FIG. 13 being a view showing the blocking between the adjacent pallets 20A/20B and FIG. 14 being a view showing the blocking 64 at the container doorway.

Figure 15:
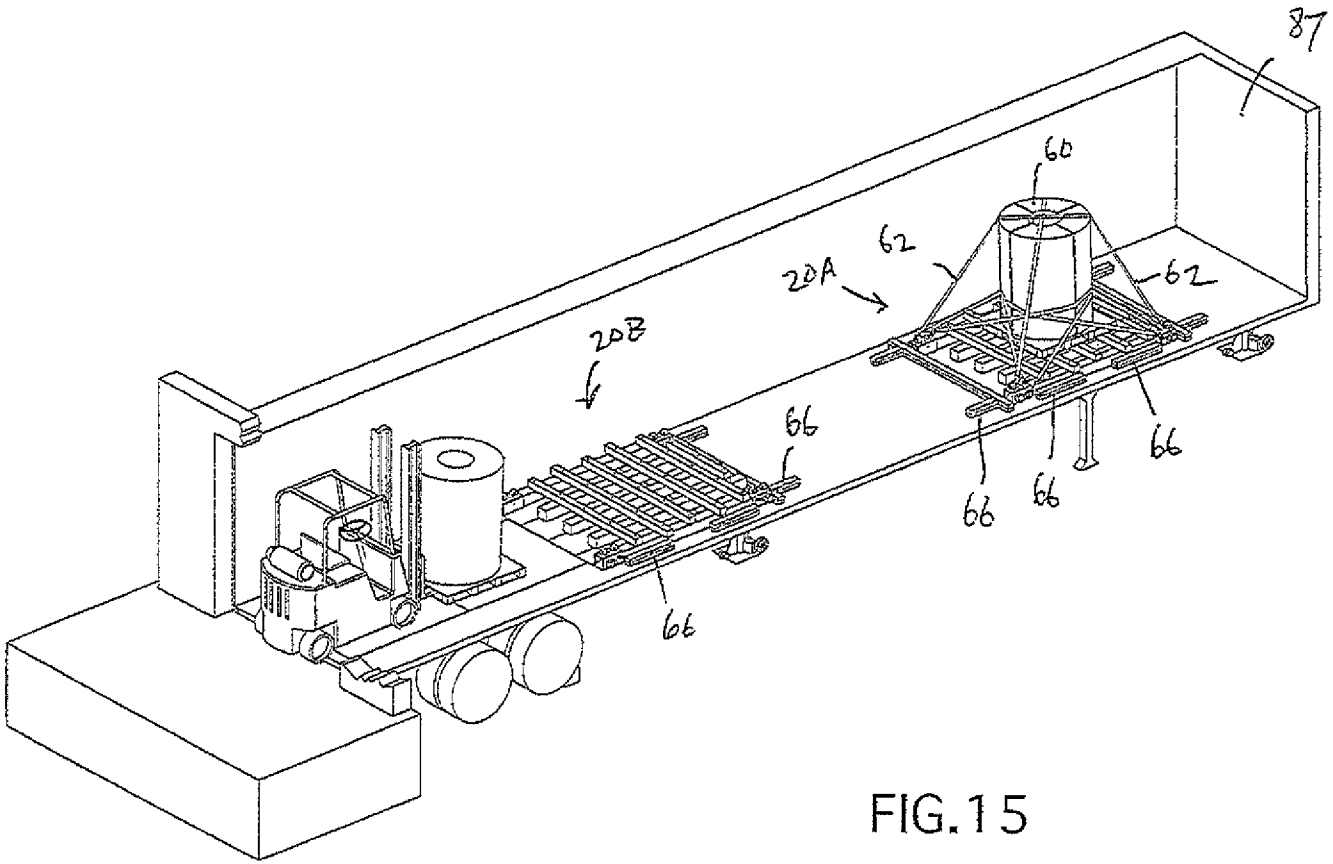
FIG. 15 is a view, similar to FIG. 11, but as part of a van trailer.

FIG. 15 shows an interim stage of an exemplary van trailer method, i.e. after the steps of:

- placing a first load equalizing pallet apparatus 20A on the floor of the van trailer 87
- placing a palletized coil 60 on the first load equalizing pallet 20A; and
- securing the load 60 to the first load equalizing pallet 20A using load binding straps 62
- placing a second load equalizing pallet 20B on the floor of the trailer Bracing 66 is also shown in FIG. 15, and it will be understood that this represents a partial attempt to secure the load equalizing pallets 20A/20B against movement.

To complete the van method (not shown):

- a second palletized coil is placed on the second load equalizing pallet 20B and secured in place with load binding straps, in a manner identical to the placement and securement of the first; and
- the pallets are secured against movement by operatively nailing the bracing to the floor of the van.

Figure 16:
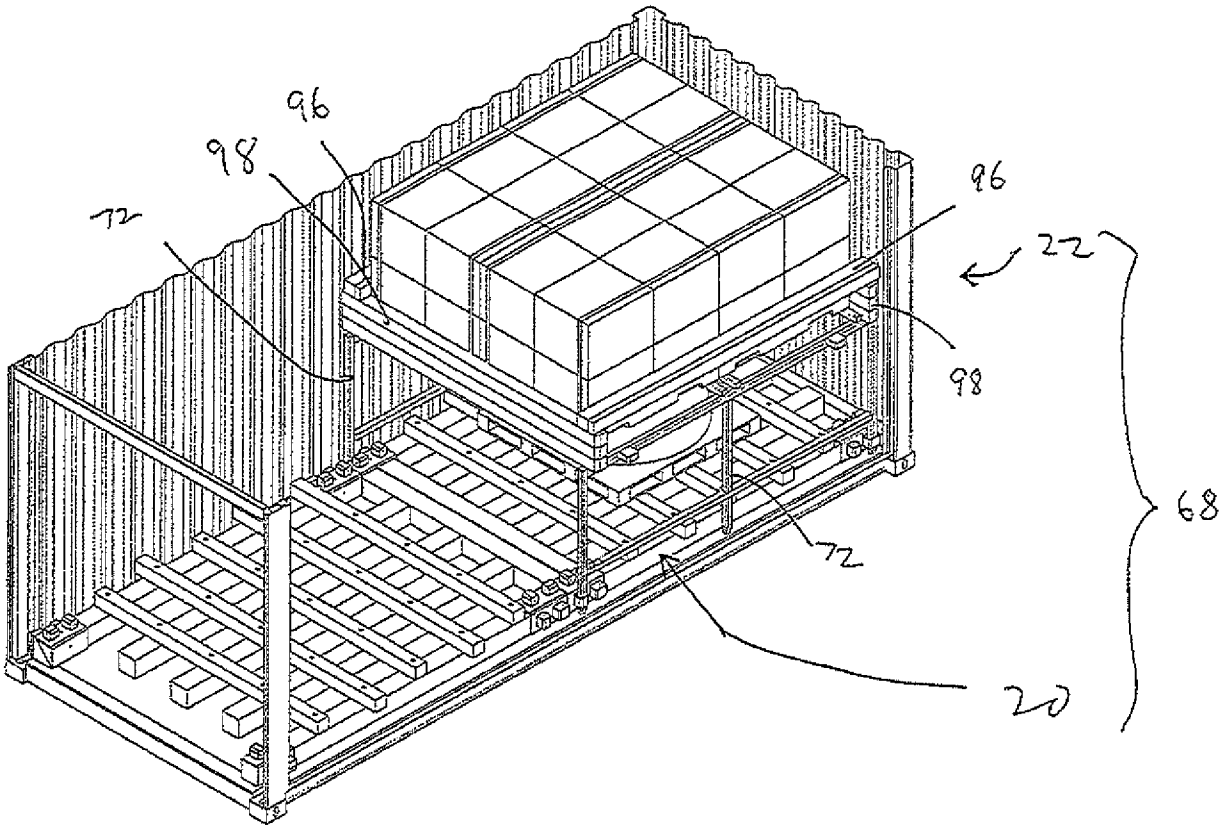
FIG. 16 is a view similar to FIG. 11 and also showing a shelf apparatus bearing a load.
Figure 17:
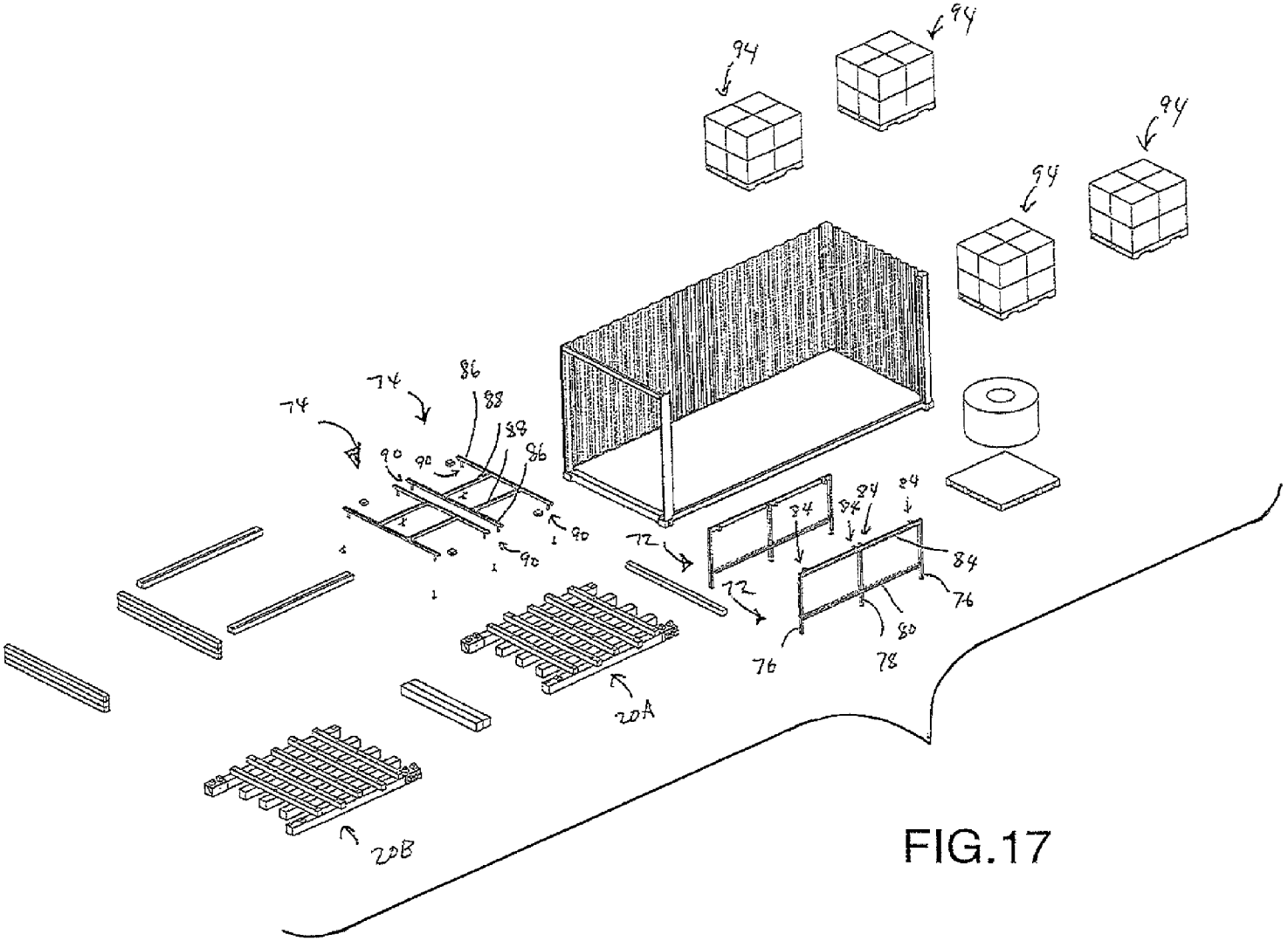
FIG. 17 is an exploded view of the structure of FIG. 16.
Figure 18:
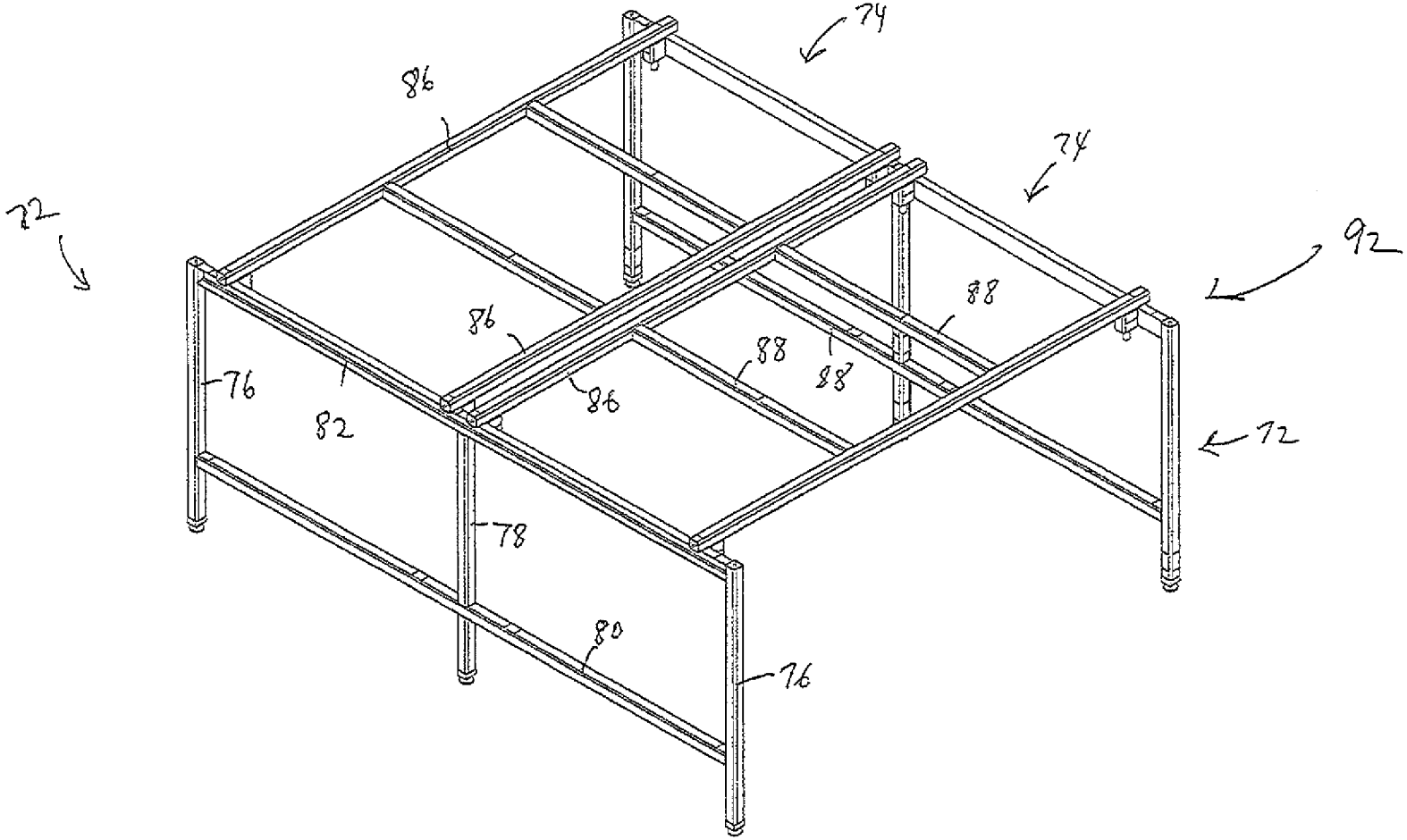
FIG. 18 is a view showing portions of the structure of FIG. 16 assembled for use.

Turning now to FIGS. 16-18 and the exemplary shipping apparatus 68 shown therein, this apparatus should be understood to include the load equalizing pallet apparatus 20 and a shelf apparatus 22.

The shelf apparatus comprises a pair of standards 72 and a pair of deck structures 74.

Each standard is a rigid frame having a pair of outer legs 76, an inner leg 78, a bottom rail 80 and a top rail 82 having four sockets 84 defined therein.

Each deck structure 74 includes a pair of parallel cross-beams 86 rigidly secured together by a pair of longitudinal braces 88. At the end of each cross beam 86 is a pin 90.

In use, as shown in FIG. 16, the standards 72 are positioned one on each side of the pallet apparatus 20 such that the outer legs 76 of the standards are fitted into outwardly-projecting lugs 44 of the pallet 20. Thereafter, the deck structures 74 are lifted onto the standards, and the pins 90 are fitted into the socket 84 such that each of said one or more deck structures span between and are coupled to the pair of standards to space the standards apart. This thus creates a load-receiving surface 92, defined by the upper surface of the deck structures, to receive skids 94 of relatively light-weight material. Prior to placement of the skids, spacer blocks 96 are wedged between the standards 72 and the wall of the container, to level and otherwise properly position the load-receiving surface. After the skids 92 have been placed, blocking 98 is wedged between the skids and the container walls, and between the skids and the front and rear legs, to avoid load shifting.

Although not shown, it will be appreciated that fork lift trucks will be used to position and place both the load-equalizing pallets and the loads, and that, depending upon loading conditions and loads, reinforcement of the floor surface with steel plates or the like may be desirable or necessary.

It will be appreciated that the foregoing provides significant advantage. For example, only:

- the present invention permits relatively heavy steel coils, along with relatively bulky, lightweight secondary loads, to be shipped in containers, van trailers or box trucks to points remote
- the nature of the components permits (i) the originating shipper to maintain a relatively large quantity of the components in inventory in a relatively small space; and (ii) permits a relatively large number of the components to be return-shipped to the originating shipper in a container or the like
- because of the relatively inexpensive nature of the load-equalizing base, and the removable nature of the shoes, it is possible at the destination of the coil/load for the wooden base to be separated from the shoes and recycled, thereby avoiding the need to return ship the wood, and the associated cost
- the various components can be relatively quickly assembled and broken down, with commensurate impacts on productivity.

The invention also permits shipping of relatively heavy reels in containers, as shown in FIGS. 19-21.

Figure 19A:
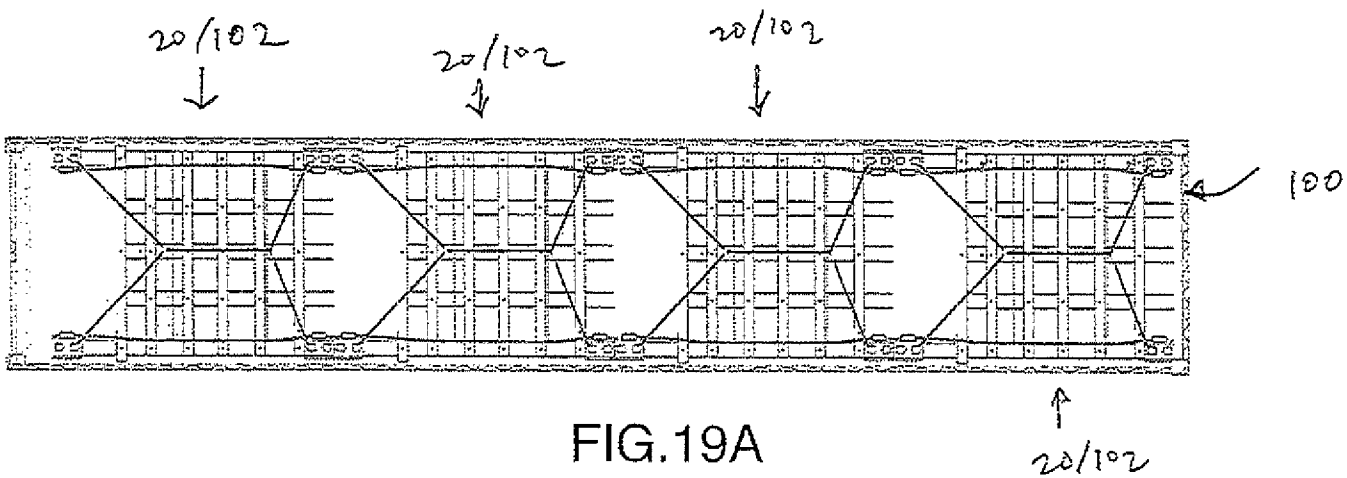
FIG. 19A is a top plan schematic view of a 40' container in which four of the load equalizing apparatus are loaded and in operative receipt of reels.
Figure 19B:
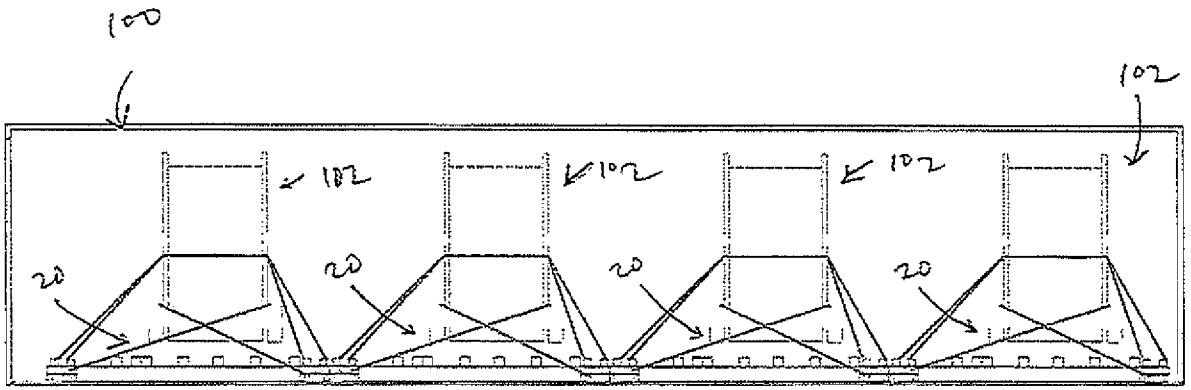
FIG. 19B is a side schematic view of the structure of FIG. 19A.
Figure 19C:
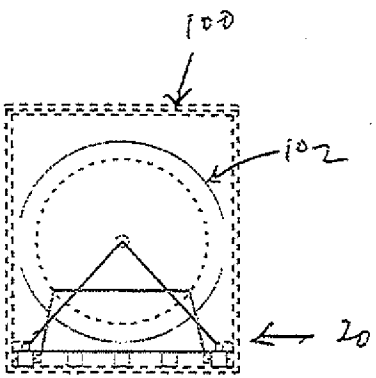
FIG. 19C is an end view of the structure of FIG. 19A.

For example, the invention can be used for the purpose of shipping four heavy reels in a 40' container:

- FIG. 19A is a top plan schematic view of a 40' container 100 in which four of the load equalizing apparatus 20 are loaded and in operative receipt of reels 102;
- FIG. 19B is a side schematic view of the structure of FIG. 19A; and
- FIG. 19C is an end view of the structure of FIG. 19A.

Figure 22B:
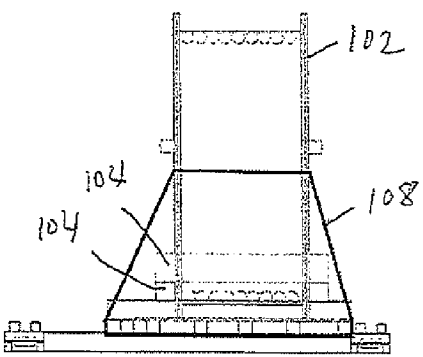
FIG. 22B is a side view of the structure of FIG. 22A.
Figure 22A:
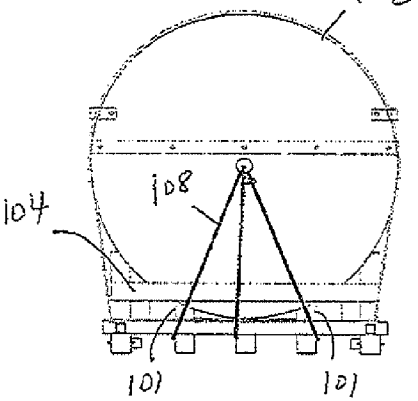
FIG. 22A is a view, similar to FIG. 21A but showing an alternate embodiment.
Figure 21B:
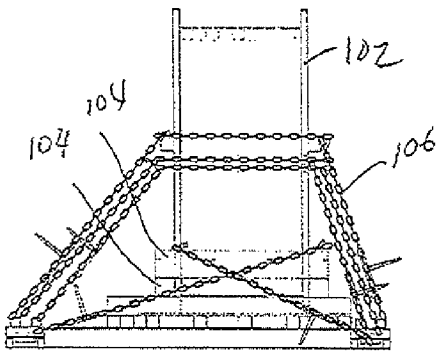
FIG. 21B is a side view of the structure of FIG. 21A
Figure 21A:
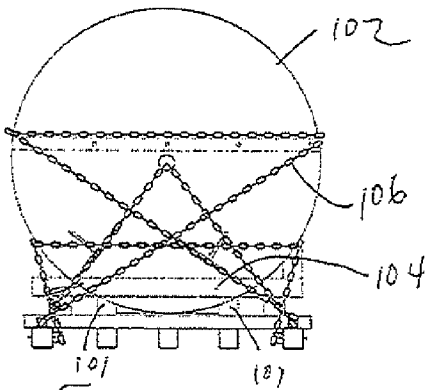
FIG. 21A is a detail end view, showing a portion of the structure of FIG. 20A.

Details of the loading methodology are shown FIGS. 21A and 21B. Herein, it will be seen that each reel 102 is supported against rolling by wood wedges 101 which are long enough to extend about 10" beyond each side of the reel 102; against tipping by blocking 104; and generally by chain lashing 106. An alternate loading methodology is shown in FIGS. 22A and 22B, which includes similar wedges 101 and blocking 104, but steel banding 108 in the place of chain lashing. The latter methodology is preferred in circumstances wherein the costs of return shipping the chain lashing would be relatively high.

Figure 20B:
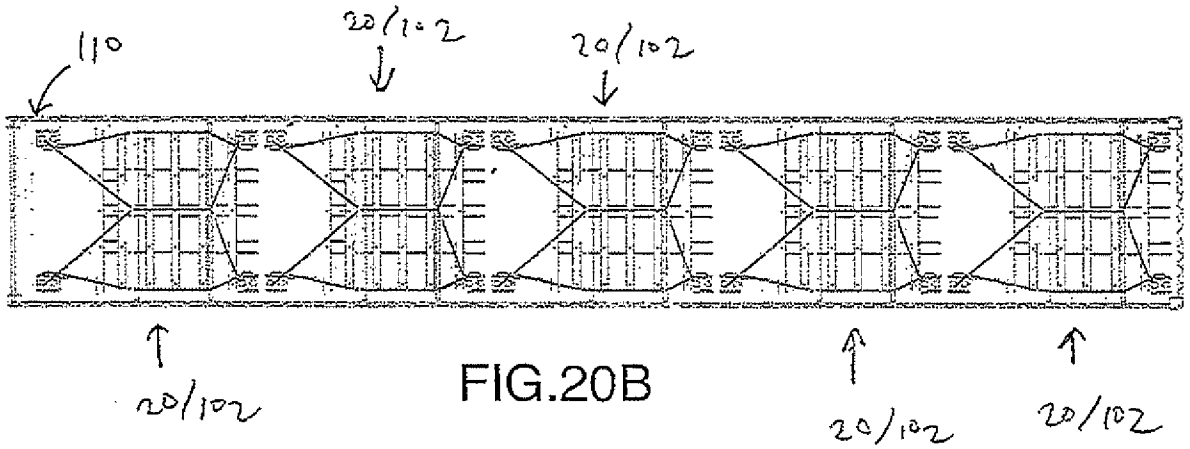
FIG. 20B is a top schematic view of the structure of FIG. 20A.
Figure 20A:
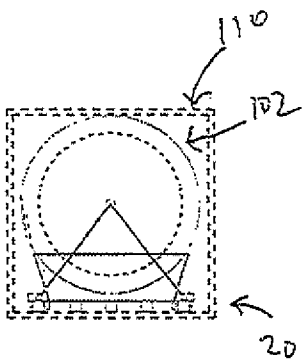
FIG. 20A is an end schematic view of a 53' container in which five of the load equalizing apparatus are loaded and in operative receipt of reels.
Figure 20C:
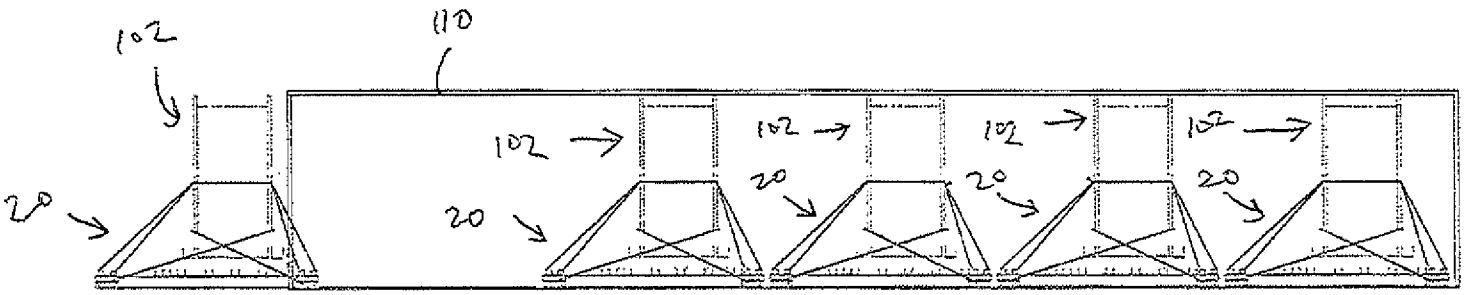
FIG. 20C is a side view of the structure of FIG. 20A but wherein one of the load equalizing apparatus in the process of removal.

As well, the invention can be used for the purpose of shipping five loaded reels in a 53' container:

- FIG. 20A is an end schematic view of a 53' container 110 in which five of the load equalizing apparatus 20 are loaded and in operative receipt of reels 102;
- FIG. 20B is a top schematic view of the structure of FIG. 20A; and
- FIG. 20C is a side view of the structure of FIG. 20A but wherein one of the load equalizing apparatus is in the process of removal.

Whereas but a few exemplary embodiments and used are described and illustrated herein, various modifications can be made without departing from the spirit of the invention. Accordingly, the invention should be understood as limited only by the accompanying claims, purposively construed.

The invention claimed is:

1. A load equalizing pallet apparatus for transporting a concentrated load and for use with load binders, the apparatus comprising:

a load equalizing base constructed substantially out of wood, having a periphery and, in use, receiving said load; and a plurality of metal shoes arranged, in use, about the periphery of the base and rigidly engaged thereto, each shoe having at least one lug, the lugs, in use, being engaged by said load binders to couple said load to said pallet, wherein the base is defined by a lattice of dimensional timbers having four corners and the shoes are arranged one at each corner; and wherein each metal shoe defines a socket which, in use, grippingly receives the timber end which defines the corner of the lattice whereat said each metal shoe is arranged.

2. Pallet apparatus according to claim 1, wherein the base is defined by a rectangular lattice of dimensional timbers.

3. Pallet apparatus according to claim 2, wherein each timber in the lattice has a pair of ends and each corner of the lattice is defined by a respective one of the timber ends.

4. Pallet apparatus according to claim 3, wherein each metal shoe defines a socket which, in use, grippingly receives the timber end which defines the corner of the lattice whereat said each metal shoe is arranged.

5. Pallet apparatus according to claim 2, wherein the lattice of dimensional timbers includes a pair of parallel timbers and the ends of said pair of parallel timbers define the corners of the lattice.

6. Pallet apparatus according to claim 1, wherein each metal shoe has a pair of lugs which, in use, present upwardly and a pair of lugs which, in use, project laterally outwardly from said pallet.

7. Method for packing a concentrated load for transport in a shipping container or dry van using the pallet apparatus of claim 6, the method comprising the steps of:

placing the apparatus in said shipping container or a dry van;

placing said load on the load equalizing pallet;

securing the load to the load equalizing pallet using load binding straps; and securing the apparatus against movement.

8. Method according to claim 7, wherein the pallet apparatus is placed in the shipping container and secured against movement by blocking the base inside the shipping container using a framework of dimensional lumber constructed on the container floor.

9. Method according to claim 7, wherein the pallet apparatus is placed in the dry van and secured against movement by nailing bracing to the floor of the dry van.

10. Shipping apparatus for transporting a concentrated load and for use with load binders, the shipping apparatus comprising:

a load equalizing base constructed substantially of wood, having a periphery and, in use, receiving said load, the base being defined by a rectangular lattice of dimensional timbers having four corners; and a plurality of metal shoes arranged, in use, about the periphery of the base and rigidly engaged thereto, the shoes being arranged one at each corner, each shoe having at least one lug, said at least one lug including at least one lug which projects laterally outwardly from said base, the lugs being engaged by said load binders to couple said load to said base; and a shelf apparatus defining, in use, a load-receiving surface disposed above the base.

11. Shipping apparatus according to claim 10, wherein the shelf apparatus comprises:

a leg for each shoe, the leg being received, in use, in one of the at least one laterally outwardly projecting lugs of said each shoe.

12. Shipping apparatus according to claim 11, wherein the shelf apparatus comprises a pair of standards, each standard being defined in part by a pair of said legs, the legs of said each standard being rigidly secured to one another.

13. Shipping apparatus according to claim 12, wherein the shelf apparatus further comprises one or more deck structures, each of said one or more deck structures spanning between and coupled to the pair of standards to space the standards apart.

14. Shipping apparatus according to claim 10, wherein each timber in the lattice has a pair of ends and each corner of the lattice is defined by a respective one of the timber ends.

15. Shipping apparatus according to claim 14, wherein each shoe defines a socket which, in use, grippingly receives the timber end which defines the corner of the lattice whereat said each shoe is arranged.

16. Pallet apparatus according to claim 15, wherein the lattice of dimensional timbers includes a pair of parallel timbers and the ends of said pair of parallel timbers define the corners of the lattice.

* * * * *